US005389755A

United States Patent [19]

Chen

[11] Patent Number: 5,389,755

[45] Date of Patent: Feb. 14, 1995

[54] COMPUTER KEY SWITCH DEVICE

[76] Inventor: Pao-Chin Chen, 4F, No. 292, Sec. 2, Chien Kuo S. Road, Taipei, Taiwan, Prov. of China

[21] Appl. No.: 144,050

[22] Filed: Oct. 27, 1993

[51] Int. Cl.[6] ..... H01H 3/12

[52] U.S. Cl. ..... 200/341; 200/517; 200/5 A; 200/345

[58] Field of Search ..... 200/517, 516, 341, 345, 200/5 A

[56] References Cited

U.S. PATENT DOCUMENTS

| | | | |
|---|---|---|---|
| 2,856,998 | 12/1974 | Sims | 200/517 X |
| 4,492,838 | 1/1985 | Fukukura | 200/517 |
| 4,527,030 | 7/1985 | Oelsch | 200/517 X |
| 4,641,004 | 2/1987 | Keprda | 200/341 |
| 4,927,990 | 5/1990 | Aoki et al. | 200/517 |
| 5,203,448 | 4/1993 | Osada et al. | 200/517 |

FOREIGN PATENT DOCUMENTS

| | | | |
|---|---|---|---|
| 273842 | 7/1988 | European Pat. Off. | 200/517 |
| 119620 | 5/1991 | Japan | 200/517 |
| 155013 | 7/1991 | Japan | 200/517 |

*Primary Examiner*—Ernest G. Cusick
*Attorney, Agent, or Firm*—Bucknam and Archer

[57] ABSTRACT

A computer a key switch device comprised of key cap, a key body plate and a rubber base plate, wherein the key body plate has a raised key body portion with a respective center hole and a pair of opposite pin holes and a pair of opposite retaining holes; the rubber base plate has a conical projection received within the raised key body portion, the conical projection having a horn-shaped bottom ring supported on a membrane, a top ring extended out of the center hole on the raised key body portion, a transverse division wall blocked between the top ring and the horn-shaped bottom ring, and a solid stub rod extended downwards from the transverse division wall at the center to trigger a circuit inside the membrane upon each down stroke of the key cap; the key cap has a plunger stopped against the top ring of the conical projection, two opposite bottom rods inserted into the pin holes on the raised key body portion, and two opposite hooks hooked in the retaining holes on the raised key body portion.

1 Claim, 3 Drawing Sheets

COMPUTER KEY SWITCH DEVICE

BACKGROUND OF THE INVENTION

The keyboard in a computer system is a device for data input, which consists of a set of keys. Once either key is pressed, a specific circuit is connected to produce a specific input signal. Regular computer keyboards may be gathered into two groups, one is the mechanical type and the other is the membrane type. In a mechanical keyboard, the keys can be conveniently arranged according to the layout of the printed circuit board. As illustrated in FIG. 1, the two pins of the key switch are inserted through holes on the printed circuit board and welded in place. This mechanical key switch is expensive to manufacture and simultaneously increases the total thickness of a keyboard. Furthermore, this mechanical key switch may be damaged easily because it is to trigger a signal by striking.

FIG. 2 illustrates a membrane key switch according to the prior art, in which a support is formed on a frame above a membrane and a plate to support a key cap by a rubber base plate permitting the plunger of the key cap to insert through a hole the frame. This arrangement greatly reduces the total thickness of a keyboard. However, because the post is directly formed on the frame, precision is very critical. Once the layout is fixed, the arrangement of the key switches on a keyboard can no longer be changed. Therefore, the tooling charge for a membrane keyboard is very expensive, and high risk is involved in making a mold according to the desired layout. This type of membrane keyboards are commonly used for notebook computers.

SUMMARY OF THE INVENTION

The present invention has been accomplished to provide a computer key switch device which eliminates the aforesaid disadvantages. According to the preferred embodiment, a computer key switch device is comprised of a key cap, a key body plate and a rubber base plate. The key body plate has a raised key body portion with a center hole and a pair of opposite pin holes and a pair of opposite retaining holes. The rubber base plate has a conical projection respectively received within either raised key body portion of the key body plate, the conical projection having a horn-shaped bottom ring supported on a membrane, a top ring extended out of the center hole on the raised key body portion, a transverse division wall blocked between the top ring and the horn-shaped bottom ring, and a solid stub rod extended downwards from the transverse division wall at the center. The key cap has a bottom plunger stopped against the top ring of the conical projection, two opposite bottom rods respectively inserted into the pin holes on the respective raised key body portion, and two opposite hooks respectively hooked in the retaining holes on the respective raised key body portion. The solid stub rod triggers a circuit inside the membrane upon each down stroke of the bottom plunger of the key cap.

DETAILED DESCRIPTION OF THE PREFERRED EMBODIMENT

Figure 1:
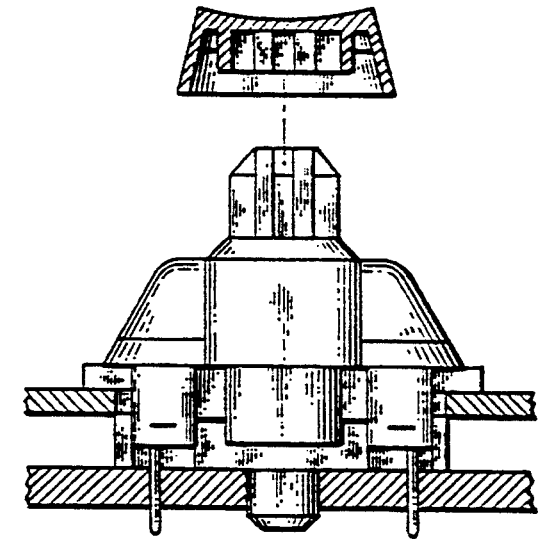
FIG. 1 (PRIOR ART)
FIG. 1 illustrates a key switch for a mechanical keyboard according to the prior art.
Figure 2:
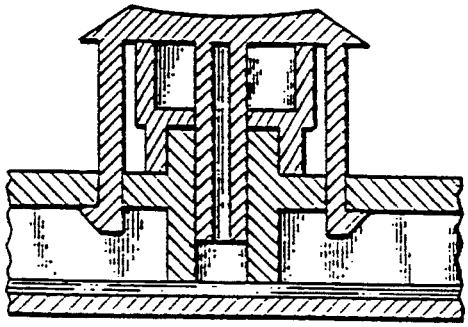
FIG. 2 (PRIOR ART)
FIG. 2 illustrates a key switch for a membrane keyboard according to the prior art.
Figure 3:
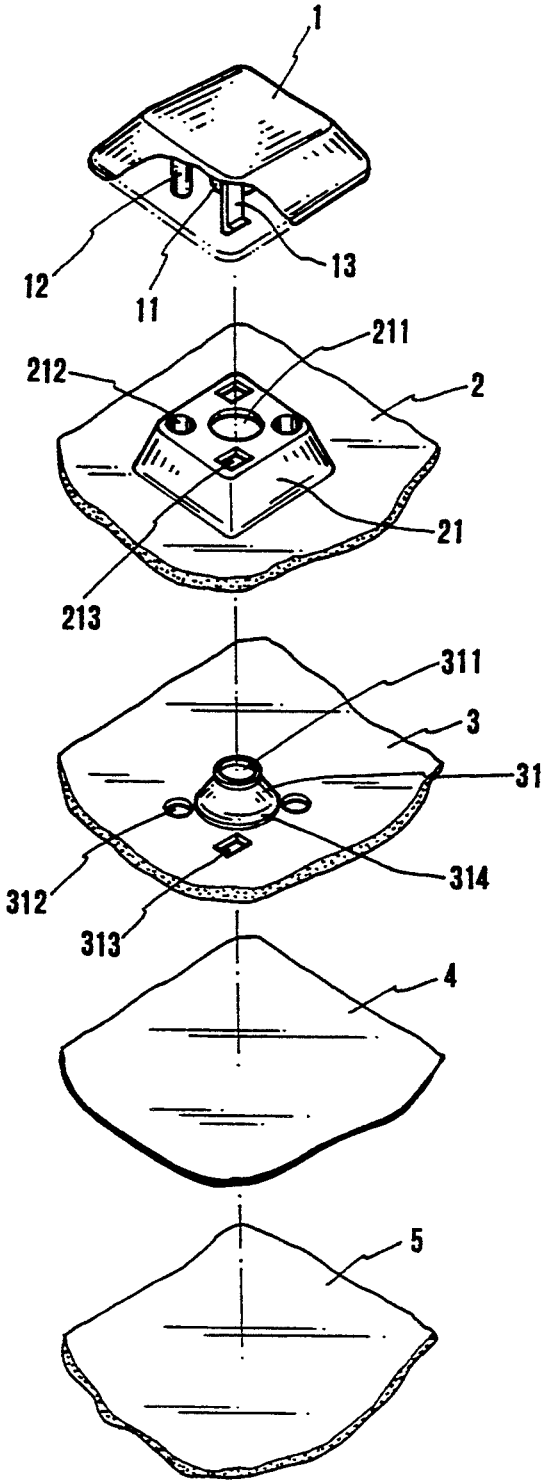
FIG. 3 is an exploded view of a key switch device embodying the present invention.
Figure 4:
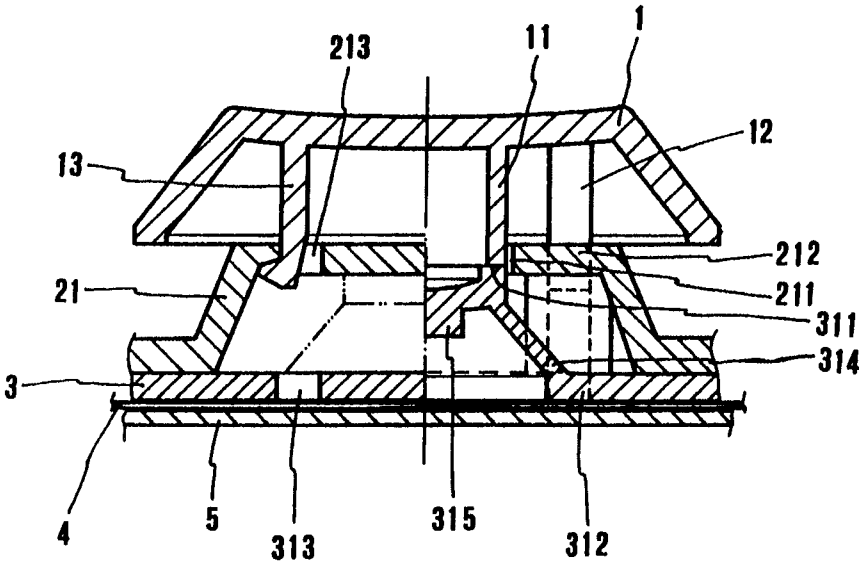
FIG. 4 is a sectional assembly view of the key switch device of FIG. 3.

Referring to FIGS. 3 and 4, a key switch as constructed in accordance with the present invention is generally comprised of a key cap 1, a key body plate 2, and a rubber base plate 3. The key cap 1 is comprised of a cylindrical bottom plunger 11 in the center, two opposite bottom rods 12 and two opposite bottom hooks 13 respectively and vertically extended from the four corners thereof. The key body plate 2 is integrally molded from plastics, having a key body portion 21 raised from the top surface thereof. The key body portion 21 comprises a center through hole 211, which receives the cylindrical bottom plunger 11 of the key cap 1, two opposite pin holes 212 and two opposite retaining holes 213 respectively disposed in the four corners of the square top surface thereof, which receive the bottom rods 12 and the bottom hooks 13 of the key cap 1 respectively. The rubber base plate 3 comprises a conical projection 31 made gradually smaller toward the top and respectively disposed within either key body portion 21 on the key body plate 2, pair of opposite pin holes 312 and pairs of opposite oblong holes 313 respectively disposed around the conical projection 31 in aligned with the pin holes 212 and retaining holes 213 on the key body portion 21 of the key body plate 2. The conical projection 31 of the rubber base plate 3 is comprised of a top ring 311, a horn-shaped bottom ring 314, a transverse division wall blocked between the top ring 311 and the horn-shaped bottom ring 314, and a solid stub rod 315 extended downwards from the transverse division wall at the center (see FIG. 4). Squeezing the conical projection 31 causes the horn-shaped bottom ring 314 to deform, and therefore the stub rod 315 is moved downward to trigger the switch inside the membrane in producing a specific input signal.

Referring to FIG. 4 again, during the assembly process, the rubber base plate 3 is mounted on the membrane 4 above the frame 5, the key body plate 2 is mounted on the rubber base plate 3 with the conical projection 31 of the rubber base plate 3 respectively received within the key body portion 2 permitting the top ring 311 of the conical projection 31 to be respectively retained above the center through hole 211 on either key body portion 21, and then the key cap 1 is respectively mounted on the key body portion 21 by inserting the bottom rods 12 of the key cap 1 into the pin holes 212 on the key body portion 21 and the pin holes 312 around the conical projection 31 on the rubber base plate 3 and by hooking the bottom hooks 13 of the key cap 1 in the oblong holes 313 on the respective conical projection 31 of the rubber base plate 3. When assembled, the bottom plunger 11 of the key cap 1 is stopped against the top ring 311 of the conical portion 31, and the bottom rods 12 and bottom hooks 13 of the key cap 1 are and movably inserted into the pin holes 212 and retaining holes 213.

Therefore, pressing the key cap 1 causes the bottom plunger 11 to squeeze the top ring 311 of the conical projection 31 of the rubber base plate 3. When squeezed by the bottom plunger 11, the horn-shaped bottom ring 312 is forced to deform permitting the stub rod 315 to be moved downward and triggering the respective circuit inside the membrane 4, and therefore a specific input signal is sent by the keyboard to a computer or the like.

As the key body portion 21 is integrally molded on the key body plate 2 and the conical projection 31 is integrally molded on the rubber base plate 3, the key switch can be quickly and accurately fastened to the membrane 4 and the frame 5 with less labor. Because the transverse division wall of the conical projection 31 on the rubber base plate is spaced from the topmost edge of the top ring 311 of the conical projection 31, downward pressure from the bottom plunger 11 of the key cap 1 is transmitted through the transverse division wall to force the stub rod 315 downward and triggering the circuit inside the membrane, and therefore less pressure is applied to the membrane. Furthermore, the pin holes 212;312 on the key body plate 2 and the rubber base plate 3 keep the key cap 1 in course during its movement; the retaining holes 213 on the key body portion 21 of the key body plate 2 keep the key cap 1 retained to the key body plate 2 without affecting its movement.

While only one embodiment of the present invention has been shown and described, it will be understood that various modifications and changes could be made without departing from the spirit and scope of the invention.

What is claimed is:

1. A computer key switch device which comprises a frame (5), a membrane (4) mounted on top of said frame, a rubber base plate (3) integrally molded from rubber and mounted on said membrane, said membrane housing a switch in the interior thereof, said rubber base plate having a conical projection (31) made gradually smaller toward the top, a pair of opposite pin holes (312) and a pair of opposite oblong holes (313) disposed around said conical projection at four corners thereof, said conical projection having a top ring (311), a horn-shaped bottom ring (314), a transverse division wall blocked between said top ring and said horn-shaped bottom ring, and a solid stub rod (315) extended downwards from said transverse division wall at the center thereof; a key body plate (2) integrally molded from plastics and mounted on said rubber base plate (3), said key body plate having a key body portion (21) raised from a top surface of said key body plate, and spaced above said conical projection (31) of said rubber base plate, said key body portion comprising a center through hole (211) through which said top ring of said conical projection projects, two opposite pin holes (212) aligned with said pair of opposite pin holes (312) on said rubber base plate, and two opposite retaining holes (213) aligned with said pair of opposite oblong holes (312) on said rubber base plate; a key cap (1) mounted on said key body portion (21) of said key body plate, said key cap comprising a bottom plunger (11) stopped against said top ring of said conical projection, two opposite bottom rods (12) inserted into said two opposite pin holes (212) on said key body portion (21), and two opposite bottom hooks (13) hooked in said two retaining holes (213) on said key body portion; wherein when said conical projection of said rubber base plate is squeezed by said bottom plunger of said key cap, the horn-shaped bottom ring of said conical projection is deformed, and the stub rod (315) of said conical projection is moved downwardly to connect with said switch in the interior of said membrane, and a circuit is triggered.

* * * * *